US006729795B2

(12) United States Patent
Dahowski et al.

(10) Patent No.: US 6,729,795 B2
(45) Date of Patent: May 4, 2004

(54) MODULAR DRAIN AND DRAIN SYSTEM

(75) Inventors: Donald E. Dahowski, York, PA (US); James G. Wilson, Lancaster, PA (US); Christopher B. Presler, Lancaster, PA (US)

(73) Assignee: Quaker Plastic Corporation, Mountville, PA (US)

( * ) Notice: Subject to any disclaimer, the term of this patent is extended or adjusted under 35 U.S.C. 154(b) by 0 days.

(21) Appl. No.: 10/259,650

(22) Filed: Sep. 30, 2002

(65) Prior Publication Data

US 2004/0062602 A1 Apr. 1, 2004

(51) Int. Cl.[7] ..... E01C 11/22

(52) U.S. Cl. ..... 404/4; 210/164; 52/169.7; 4/510; 405/36

(58) Field of Search ..... 404/2–4; 405/43, 405/47, 51, 118, 119, 120, 121, 36; 210/163, 164; 52/12, 169.7; 4/510

(56) References Cited

U.S. PATENT DOCUMENTS

| | | | | |
|---|---|---|---|---|
| 3,876,322 | A | 4/1975 | Deason | 404/2 |
| 4,365,911 | A | 12/1982 | Rossberg | 405/43 |
| 4,490,067 | A | 12/1984 | Dahowski | 404/4 |
| 4,815,888 | A | 3/1989 | Stegmeier | 404/4 |
| 4,906,129 | A | 3/1990 | Stegmeier | 404/64 |
| 4,910,811 | A | 3/1990 | Izzi, Sr. | 4/292 |
| 5,024,550 | A | 6/1991 | Mainville | 404/4 |
| 5,026,202 | A | 6/1991 | Thomann | 404/4 |
| 5,061,116 | A | 10/1991 | Monks | 405/43 |
| 5,066,165 | A | 11/1991 | Wofford et al. | 405/119 |
| 5,181,793 | A | 1/1993 | Dekel | 404/4 |
| 5,213,438 | A | 5/1993 | Bärenwald | 404/2 |
| 5,226,748 | A | 7/1993 | Bärenwald et al. | 405/121 |
| 5,281,052 | A | 1/1994 | Beamer | 405/119 |
| 5,340,234 | A | 8/1994 | Rossi et al. | 405/48 |
| 5,454,663 | A | 10/1995 | Stegmeier | 404/2 |
| 5,466,091 | A | 11/1995 | Sauerwein et al. | 405/36 |
| 5,501,547 | A | 3/1996 | Mantelli | 405/121 |
| 5,522,675 | A | 6/1996 | Gunter | 405/118 |
| 5,529,436 | A | 6/1996 | Meyers | 404/3 |
| 5,628,152 | A | 5/1997 | Bowman | 52/20 |
| 5,645,367 | A | 7/1997 | Gunter | 405/119 |
| 5,882,145 | A | 3/1999 | Beamer | 405/118 |
| 5,971,662 | A | 10/1999 | Becker et al. | 405/119 |
| 6,027,283 | A | 2/2000 | Schweinberg et al. | 405/42 |

OTHER PUBLICATIONS

Stegmeier Corporation, Web Archive, 1999.*
Stegmeier Corporation, Frontier Deck Drain, catalog p. 43, webpage from www.stegmeier.com/products.
Stegmeier Corporation, Deck Drain, catalog p. 44.
Stegmeier Corporation, Channel Drain, catalog p. 45, webpage from www.stegmeier.com/products.
Stegmeier Corporation, Super Drain, catalog p. 46, webpage from www.stegmeier.com/products.
Mortex Manufacturing Co., Inc. webpages from www.mortex.com/products, Drain Rite Technical Data and Replacement Top Technical Data, 2 pages.

* cited by examiner

*Primary Examiner*—Robert E. Pezzuto
*Assistant Examiner*—Tara L. Mayo
(74) *Attorney, Agent, or Firm*—Nixon Peabody LLP; Daniel S. Song

(57) ABSTRACT

A modular drain for receiving drainage liquid with a polygonal upper portion and a lower portion. The upper portion has a substantially lateral surface, a first vertical surface and a second vertical surface that define an upper cavity, the substantially lateral surface having a plurality of openings thereon. The lower portion is joined to the upper portion, the lower portion including a substantially semi-circular surface sized to receive a tube section of a connector therein. In one embodiment, at least one of the first vertical surface and the second vertical surface includes a retention mechanism that is sized and positioned to retain the tube section in the lower portion. In another embodiment, the vertical surfaces are provided with interlocking interfaces.

39 Claims, 4 Drawing Sheets

MODULAR DRAIN AND DRAIN SYSTEM

BACKGROUND OF THE INVENTION

1. Field of the Invention

The present invention is directed to a drain and drain systems, and more particularly, to modular drains and modular drain systems.

2. Description of Related Art

A variety of drains and drain systems for carrying away accumulation of liquid are known in the art. In the vicinity of swimming pools and in enclosed shopping malls, for example, it is very important that accumulated liquid such as water be removed and that seepage to the substrate beneath be prevented. In particular, moisture or dislocation damage can occur as a result of seepage of accumulated liquid. In addition, freezing of such seepage liquid can cause further damage to the pool body itself, to decks, or to the surrounding structure.

Any dislocations or leaks in the drain system are undesirable because moisture penetrating the underlying soil causes dampness problems, and may result in the ramp or deck to swell and heave. A further requirement of drain systems is that they be adapted to be installed and fitted essentially flush against contiguous vertical walls such as in a corner or against a building wall to drain away liquid that might otherwise accumulate and develop into an unsanitary condition.

U.S. Pat. No. 3,876,322 discloses a combined drain and expansion and contraction joint to absorb pressure and avoid damage which may result from the heating and cooling of concrete slabs or sections. Such drain structures have a number of disadvantages including the fact that relatively extensive amount of on site time and labor is required for proper installation. In addition, these drain structures are difficult to install because the installer must align and hold the drain secure while the drain is embedded in concrete. Another disadvantage is that difficult and time-consuming on site operations are necessary to provide a liquid tight integrated system. Consequently, conventional drain system do not provide an easily installable, essentially liquid tight, drain system.

In the above regard, U.S. Pat. No. 4,490,067 assigned to the assignees of the present application discloses a modular drain and drain system that facilitates pre-assembly of the components of the drain system to reduce on site labor and fabrication. The disclosed drain may be used to drain surface liquids, for instance, in a deck which surrounds a swimming pool, shopping mall, or any concrete or paved area. The disclosed drain also functions as an expansion joint to accommodate expansions and contractions in concrete slabs into which the drain is embedded, thereby reducing cracking and/or other damage that may result from contraction/expansion forces. The disclosed modular drain system is adapted to be aligned and secured on the ground while concrete is poured around the anchored drain, and may be attached to a conventional cylindrical drain pipe to conduct liquid accumulated therein.

Furthermore, U.S. Pat. No. 5,454,663 discloses a replacement re-cover drain top in which the drain includes a conduit cavity positioned below the surface level of the adjacent decking, and a top surface disposed substantially flush therewith. Transverse apertures of the drain top permit decking drainage to enter the drain and be conducted through the conduit to a suitable disposal site.

SUMMARY OF THE INVENTION

Although the above noted drainage systems have addressed many disadvantages of conventional drains and drain systems, there still exists an unfulfilled need for an improved drain and drain system that is provided in modular form with increased flow capacity and which further facilitates on-site installations. In this regard, there exists an unfulfilled need for a drain and drain system that includes provisions for retaining connectors so that the components of the drain system may be readily assembled together using such connectors. In addition, there exists an unfulfilled need for such a drain that can be manufactured economically.

In view of the foregoing, an advantage of the present invention is in providing an improved modular drain and drain system with increased flow capacity.

Another advantage of the present invention is in providing a modular drain and drain system that facilitates on-site installations.

Still another advantage of the present invention is in providing a modular drain and drain system that includes provisions for retaining connectors so that the modular pieces of the drain may be readily assembled together using such connectors.

Yet another advantage of the present invention is in providing a modular drain and drain system having the above noted advantages that can be economically manufactured.

These and other advantages and features of the present invention are attained by a modular drain for receiving drainage liquid comprising a polygonal upper portion and a lower portion. The upper portion has a substantially lateral surface, a first vertical surface and a second vertical surface, the first and second vertical surfaces extending from edges of the substantially lateral surface to define an upper cavity, and the substantially lateral surface having a plurality of openings thereon to allow entry of liquid into the upper cavity. The lower portion is joined to the upper portion, the lower portion including a substantially semi-circular surface joined to the first and second vertical surfaces of the upper portion, the substantially semi-circular surface of the lower portion being sized to receive a tube section of a connector therein. In accordance with the present invention, at least one of the first vertical surface and the second vertical surface includes a retention mechanism that is sized and positioned along the at least one of the first vertical surface and the second vertical surface to retain the tube section in the lower portion.

In one embodiment, the semi-circular surface has a radius in the range of approximately 0.95 to 0.975 inch, inclusive and the tube section has a radius of approximately 0.95 inch. The retention mechanism inwardly protrudes into the upper cavity to contact and retain the tube section in the lower portion and is preferably provided on both the first vertical surface and the second vertical surface. In one embodiment, the retention mechanism contacts and retains an outer surface of the tube section of the connector at approximately 10 o'clock and 2 o'clock positions. The retention mechanism may be a retention groove that inwardly protrudes into the upper cavity and is adapted to receive at least one of concrete and aggregate therein. In such an embodiment, the retention groove may be substantially semi-circular having a radius of approximately 0.125 inch and positioned approximately 1.625 inches from a bottom of the semi-circular surface.

In accordance with another embodiment, the first vertical surface and/or the second vertical surface includes an inwardly protruding ancillary groove adapted to receive at least one of concrete and aggregate therein. In another embodiment, the substantially lateral surface of the polygonal upper portion includes at least one sloping portion that directs flow toward the plurality of openings. In yet another embodiment, the substantially lateral surface of the polygonal upper portion has a thickness greater than at least one of the first vertical surface and the second vertical surface. Moreover, the lower portion may be provided with support feet adapted to resist tipping of the modular drain.

In accordance with one embodiment, the lower portion is joined to the upper portion. In another embodiment, the first and second vertical surfaces of the upper portion are provided with interlocking interfaces. The interlocking interfaces may include interlocking protrusions that interlock with the retention mechanisms.

The upper portion and/or the lower portion may be made of at least one of a plastic and resin material. In this regard, the material is preferably selected from a group consisting of polyvinyl chloride, polyethylene, polypropylene, polycarbonate, nylon, polyester, polymethylmethacrylate, and composites thereof. An extrusion process may be used to manufacture the upper portion and the lower portion together using the same or different materials.

In accordance with another aspect of the present invention, a modular drain for receiving drainage liquid is provided comprising a polygonal upper portion having a substantially lateral surface, a first vertical surface and a second vertical surface, the first and second vertical surfaces extending from edges of the substantially lateral surface to define an upper cavity, and the substantially lateral surface having a plurality of openings thereon to allow entry of liquid into the upper cavity, and a lower portion joined to the upper portion, the lower portion including a substantially semi-circular surface sized to receive a tube section of a connector therein. The first and second vertical surfaces of the upper portion are provided with interlocking interfaces which may include interlocking protrusions that are adapted to allow assembly of the modular drain.

In one embodiment, the first vertical surface and the second vertical surface are provided with a retention mechanism such as retention grooves that are sized and positioned along the first vertical surface and the second vertical surface to retain the tube section in the lower portion. In this regard, the retention grooves are sized to interlock with the interlocking protrusions.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENT

Figure 1:
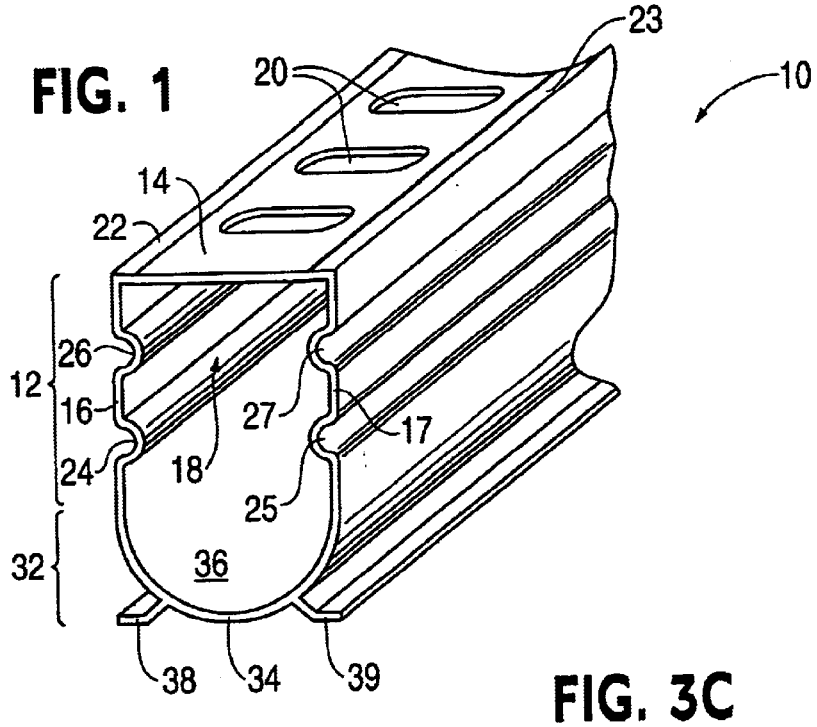
FIG. 1 is a partial side perspective view of the modular drain in accordance with one embodiment of the present invention.
Figure 2:
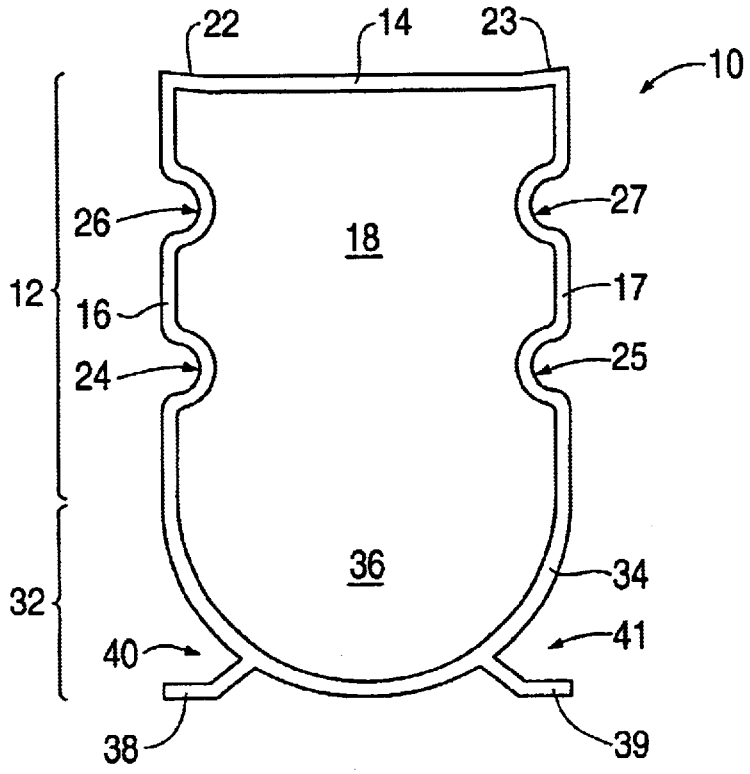
FIG. 2 is an end profile view of the modular drain of FIG. 1.

FIG. 1 shows a partial perspective view of the modular drain 10 in accordance with one embodiment of the present invention. It should be initially noted that the modular drain 10 may also be referred to as a conduit and may be used for conducting liquid and also serves as an expansion and/or contraction joint when installed. It should also be noted that the liquid may be water, chemically treated water, liquid chemicals, or any other liquid suitable for conduction by the modular drain of the present invention. FIG. 1 merely shows a small segment of the modular drain 10 which may be an elongated component of varying length. In this regard, multiple segments of the modular drain 10 may be interconnected together using connectors in the manner described below to provide a modular drain system. FIG. 2 shows an end profile view of the modular drain 10 of FIG. 1, both of these figures being referred to herein below for clarity.

As shown, the modular drain 10 includes an upper portion 12 which is substantially polygonal in shape and is open toward a lower portion 32. In the illustrated embodiment, the modular drain 10 is a single unitary unit with the lower portion 32 being integrally joined to the upper portion 12.

The upper portion 12 of the modular drain 10 includes a lateral surface 14, and left and right vertical surfaces 16 and 17, respectively, that extend from the side edges of the lateral surface 14. The lateral surface 14, the left vertical surface 16, and the right vertical surface 17 define an upper cavity 18 in the upper portion 12 that receives liquid from a surface such as a pool deck to which the modular drain 10 is applied.

The lateral surface 14 of the upper portion 12 is provided with a plurality of openings 20 that are spaced along the length of the modular drain 10 as shown in FIG. 1 which allows the liquid to enter the upper cavity 18. Whereas in the illustrated embodiment the openings 20 are lateral slots extending partially across the lateral surface 14, the openings may be of different shape and/or orientation, for instance, be rectangular, squares, diagonally off-set, etc. In addition, as most clearly shown in FIG. 2, the illustrated embodiment of the upper portion 12 is also provided with sloping portions 22 and 23 at the edges that slope toward the openings 20 of the lateral surface 14. The sloping portions 22 and 23 encourage even small quantities of liquid on the lateral surface 14 to be drawn into the openings 20 via the force of gravity.

Furthermore, in the illustrated embodiment, the left vertical surface 16 and the right vertical surface 17 of the upper portion 12 are provided with a retaining mechanism or mechanisms such as retaining grooves 24 and 25, respectively, which act to retain connectors in the manner discussed in further detail below. In addition, in the illustrated embodiment, the left vertical surface 16 and the right vertical surface 17 of the upper portion 12 are also provided with auxiliary grooves 26 and 27, respectively, which are also discussed in further detail below.

As shown, the retaining grooves 24 and 25, and the auxiliary grooves 26 and 27 are horizontally elongated grooves extending along the length of the modular drain 10. These grooves are formed integrally with the modular drain 10 to impart further rigidity and strength to the modular drain 10 so that the modular drain 10 is resistant to collapse, even when supporting weight of individuals walking on the modular drain 10. These grooves are inwardly directed so that they extend into the upper cavity 18. However, the grooves should not extend into the upper cavity 18 too much so that the flow and volumetric capacity of the modular drain 10 is not significantly reduced.

Of course, whereas in the illustrated embodiment, the retaining grooves 24 and 25, and the auxiliary grooves 26 and 27 are semi-circular in shape, they may be formed with different shapes in other embodiments. However, the semi-circular shape and the inward orientation of the retaining grooves 24 and 25, and the auxiliary grooves 26 and 27 allow the grooves to receive poured concrete during installation of the modular drain 10 to form a pair of liquid stops that resists seepage of liquid along the left and right vertical surfaces 16 and 17 of the upper portion 12 once the drain 10 is embedded in concrete or other aggregate. Furthermore, the inward orientation of the grooves and the received concrete therein during installation acts to lock the modular drain 10 in place within the concrete/aggregate. This reduces the likelihood of unintended extraction of the modular drain 10 after the modular drain 10 has been installed. It should also be noted that whereas in the embodiment discussed above, the retaining mechanisms are shown as grooves, in other embodiments, they may merely be protrusions on the left and right vertical surfaces 16 and 17 that extend into the upper cavity 18, and not grooves. However, as explained above, the grooves provide added advantage in that concrete or other aggregate can be received in the groove to resist liquid seepage and to minimize unintentional removal of the modular drain 10 once it is installed.

As previously noted, the left and right vertical surfaces 16 and 17 of the upper portion 12 are integrally joined to the semi-circular surface 34 of the lower portion 32 in the manner shown. The semi-circular surface 34 defines a lower cavity 36 that contains the liquid from the upper cavity 18 and conducts it to a specific location for disposal. The semi-circular surface 34 of the lower portion 32 is adapted to receive a connector therein as discussed in further detail below. In this regard, in the one embodiment, the semi-circular surface 34 of the lower portion 32 has an inside radius of curvature generally equal to, or very slightly larger than, the outside radius of standard tube sections used for conventional connectors. For instance, in one preferred embodiment, the semi-circular surface 34 has an inside radius of approximately 0.95–0.975 inch to correspond to the outer radius of approximately 0.95 inch of standard tube sections for conventional connectors. By adapting the modular drain 10 to accept standard tube sections for conventional connectors such as those shown and discussed below, the costs associated with the manufacture and use of the modular drain 10 is minimized.

In the illustrated embodiment, the lower portion 32 of the modular drain 10 is also provided with support feet 38 and 39 which support the modular drain 10 on a surface so as to prevent the modular drain 10 from tipping to one side, especially during pouring of concrete or other aggregate around the left and right vertical surfaces 16 and 17. In this embodiment, the support feet 38 and 39 extend at about 45 degrees downwardly and outwardly, and are integrally formed near the bottom of the lower portion 32. For instance, the support feet 38 and 39 of the illustrated embodiment are integrally formed at approximately 5 and 7 o'clock positions on the lower portion 32 when viewed from the end profile view of FIG. 2. The support feet 38 and 39 facilitate the installation and use of the modular drain 10 by resisting tipping during installation. In addition, the support feet 38 and 39 forms relatively shallow grooves 40 and 41 that receive poured concrete along the bottom of the modular drain 10 so that unintended extraction of the installed modular drain 10 is further resisted.

As previously noted, the retaining grooves 24 and 25 are dimensioned and positioned to engage the exterior surface of a tube section for a connector. For instance, in the present illustrated embodiment of FIGS. 1 and 2, the retaining grooves 24 and 25 are dimensioned and positioned on the left and right vertical surfaces 16 and 17 respectively so that the retaining grooves 24 and 25 contact and retain in place, a tube section of a connector.

Figure 3A:
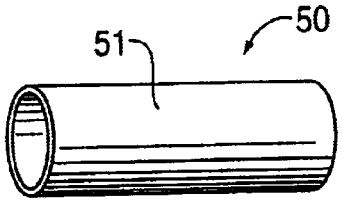
FIG. 3A is a perspective view of a connector in accordance with one embodiment that may be used in a modular drain system in accordance with the present invention.
Figure 3C:
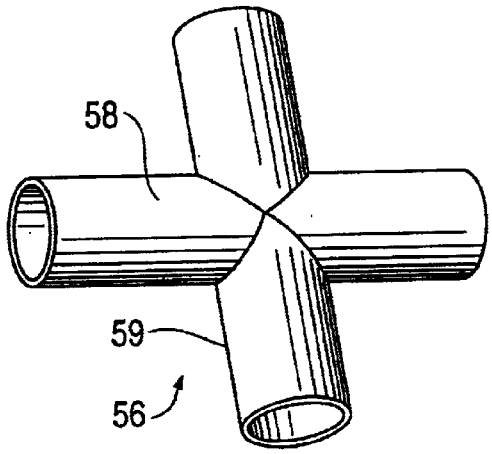
FIG. 3C is a profile view of a connector in accordance with still another embodiment.
Figure 3B:
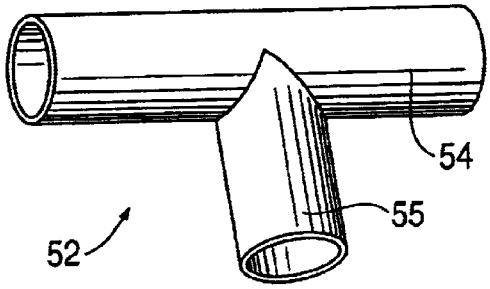
FIG. 3B is a perspective view of a connector in accordance with another embodiment.

FIGS. 3A to 3C show various connectors that may be used to interconnect together two or more modular drains of the present invention. In particular, FIG. 3A shows a perspective view of a straight connector 50 that is essentially a tube section 51 that is dimensioned so that it can be readily received in the modular drain 10. Similarly, FIG. 3B shows a T-connector 52 that includes a first tube section 54 that is perpendicularly bisected by a second tube section 55. FIG. 3C shows an X-connector 56 that includes a first tube section 58 is perpendicularly bisected by a second tube section 59. Preferably, the tube sections for these connectors have a conventional radius of 0.95 inch so that costs associated with manufacture and use of the drain is minimized. Of course, these dimensions are provided as an example only and alternative dimensions may be used in other embodiments and applications.

These connectors may be used to interconnect two or more adjacent modular drains of the present invention, and further allows intersections to be incorporated to accommodate drainage needs of the specific application. In particular, the connectors are used to connect two or more modular drains together and are preferably, partially received in the lower portion of one modular drain, and partially received in the lower portion of an adjacent modular drain. In this regard, the tube sections of the connectors may be bonded to the semi-circular surface 34 and/or the retaining grooves 24 and 25 using an adhesive, welds, or the like, depending on the composition of the modular drain and the tube section(s) of the connectors. When connected in the described manner, the liquid can be readily conducted through plurality of interconnected modular drains, the connectors allowing the conduction of drained liquid from one modular drain to another at the interface thereof.

Figure 4:
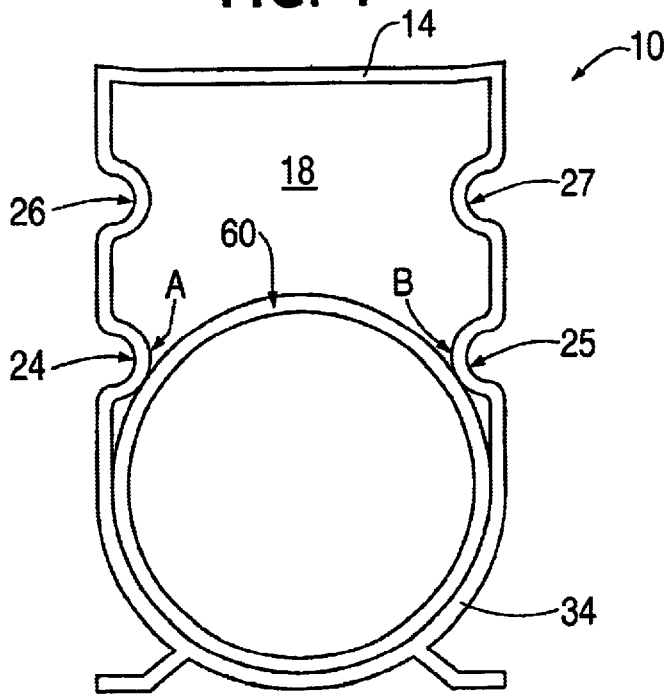
FIG. 4 is an end profile view of the modular drain of FIG. 1 assembled together with a tubular segment of a connector.

FIG. 4 is an end profile view of the modular drain 10 of FIG. 1 assembled together with a tube section 60 of a connector. The tube section 60 may be from any appropriate connector such as those shown and described above relative to FIGS. 3A to 3C. As shown, the tube section 60 is installed in the modular drain 10 so that the tube section 60 is supported by the semi-circular surface 34 and the retaining grooves 24 and 25. In this regard, as previously noted, the tube section 60 is approximately 0.95 inch in radius while the semi-circular surface 34 has an inside radius of approximately 0.95–0.975 inches to correspond thereto. As also shown in FIG. 4, the retaining grooves 24 and 25 are sized and positioned so that they contact and retain the outer surface of the tube section 60 at interfaces "A" and "B", respectively, which correspond to 10 and 2 o'clock positions when the modular drain 10 is viewed from the side. Of course, it should be noted that any other appropriately sized connector such as those shown in FIGS. 3B and 3C would be supported in the modular drain 10 in substantially the same manner.

As described above, it should now be apparent that the size and position of the retaining grooves 24 and 25 should be selected to cause the tube section 60 to be retained in place while leaving the maximum unrestricted passage for liquid flow through the upper cavity 18 of the modular drain 10. If the retaining grooves 24 and 25 protrude too much into the upper cavity 18, they would reduce the flow and volume capacity of the drain 10. Thus, the dimension of the grooves is chosen to be large enough to maximize flow and volume capacity, and yet small enough to preserve strength in the vertical surfaces, and to form an appropriate retaining mechanism for the tube section 60. In this regard, in the illustrated embodiment, the retaining grooves 24 and 25 are semi-circular in shape having a radius of approximately 0.125 inch, and is positioned so that the centerline of the grooves are elevated about 1.625 inches from the bottom of the semi-circular surface 34. In the illustrated embodiment, the modular drain 10 is approximately 2.05 inches in width across the lateral surface 14 of the upper portion 12, and is approximately 3.25 inches in height from the bottom of the support feet to the top of the lateral surface 14. Of course, the various dimensions described herein relative to the illustrated embodiment are provided as an example only and alternative dimensions may be used in other embodiments.

Figure 5:
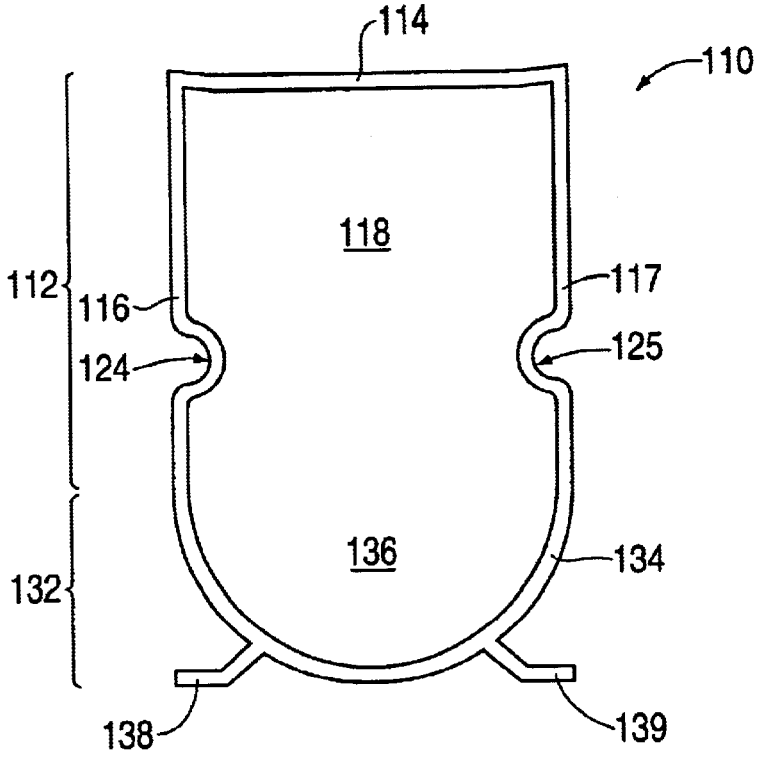
FIG. 5 is an end profile view of the modular drain in accordance with another embodiment of the present invention.

FIG. 5 shows an end profile view of a modular drain 110 in accordance with another embodiment of the present invention which is substantially similar to the modular drain 10 discussed above. In this regard, the modular drain 110 includes an upper portion 112 having left and right vertical surfaces 116 and 117, as well as a lateral surface 114 that allows liquid or other liquid to be drained to enter the upper cavity 118. Like the previous embodiment, the upper portion 112 is integrally joined to the lower portion 132. In particular, the left and right vertical surfaces 116 and 117, respectively, are integrally joined to the semi-circular surface 134 of the lower portion 132 in the manner shown, the semi-circular surface 134 defining a lower cavity 136. The modular drain 110 is also provided with support feet 138 and 139 for facilitating installation of the modular drain 110.

In contrast with the embodiment shown in FIG. 1, the modular drain 110 of FIG. 5 does not have auxiliary grooves so that left and right vertical surfaces 116 and 117 of the upper portion 112 is provided with only retaining grooves 124 and 125. The retaining grooves 124 and 125 are sized and positioned to cause tube sections of connectors to be retained in place while leaving the maximum unrestricted passage for liquid flow through the upper cavity 118 of the modular drain 110.

Figure 6:
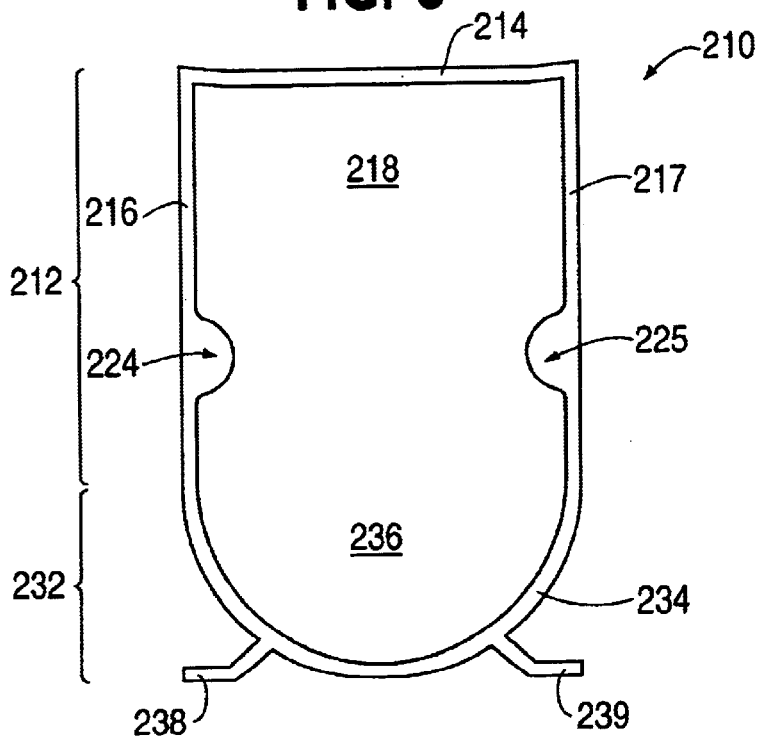
FIG. 6 is an end profile view of the modular drain in accordance with still another embodiment of the present invention.

FIG. 6 shows an end profile view of a modular drain 210 in accordance with still another embodiment of the present invention which is substantially similar to the modular drain 110 discussed above. The modular drain 210 includes an upper portion 212 having left and right vertical surfaces 216 and 217, as well as a lateral surface 214 that allows liquid or other liquid to be drained to enter the upper cavity 218. The upper portion 212 is integrally joined to the lower portion 232 having a semi-circular surface 234 that defines a lower cavity 236. The modular drain 210 is also provided with support feet 238 and 239 for facilitating installation of the modular drain 210.

The modular drain 210 of FIG. 6 also does not have auxiliary grooves or retaining grooves. In contrast, the left and right vertical surfaces 216 and 217 of the upper portion 212 is provided with only retaining mechanisms 224 and 225 which protrude into the upper cavity 218 and are sized and positioned to cause tube sections of connectors to be retained in place while leaving the maximum unrestricted passage for liquid flow through the upper cavity 218 of the modular drain 210. Of course, other various embodiments may implement other various shapes for the retaining mechanism and the present invention should be construed to encompass such variations.

Figure 7:
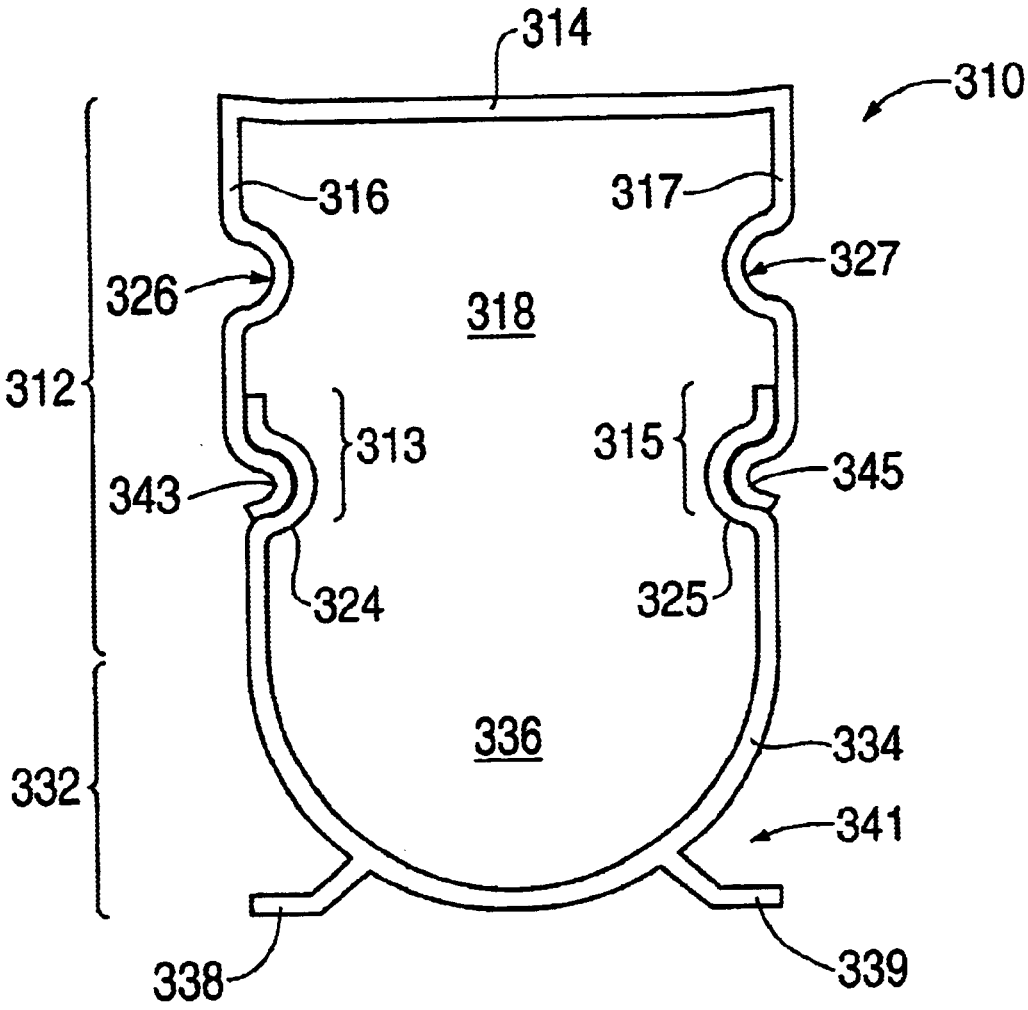
FIG. 7 is an end profile view of the modular drain in accordance with yet another embodiment of the present invention.

FIG. 7 is an end profile view of the modular drain 310 in accordance with yet another embodiment of the present invention which is made of two separate components that are interlocked together so that the modular drain 310 is an assembled unit. In this regard, the modular drain includes an upper portion 312 with a lateral surface 314 that allows liquid or other liquid to be drained to enter the upper cavity 318, and a lower portion 332 having a semi-circular surface 334 that defines a lower cavity 336. The modular drain 310 is also provided with support feet 338 and 339 for facilitating installation of the modular drain 310 as previously described.

Like the previous embodiments, the upper portion 312 of the modular drain 310 has left and right vertical surfaces 316 and 317. However, in the present embodiment, the upper portion 312 is defined by two separate portions that are interlocked together along interlocking interfaces 313 and 315, respectively. In particular, as shown, retaining grooves 324 and 325 are integrally joined to the lower portion 332 of the modular drain 310. These retaining grooves 324 and 325 are engaged by the interlocking protrusions 343 and 345, respectively, of the upper portion 312 to thereby form the modular drain 310 as an assembled unit. Of course, other types of interlocking protrusions may be provided as well, and the interlocking protrusions 343 and 345 are illustrated merely as one example. For example, in other embodiments, the interlocking interfaces may be provided with clips, snap-in, fastening extensions, or other interlocking mechanisms to allow the modular drain to be assembled into an assembled unit.

By providing a modular drain 310 in which the upper portion 312 is provided with interlocking interfaces 313 and 315, the described embodiment of the modular drain 310 may be easily made with different materials. For instance, the part of the upper portion 312 provided with the interlocking protrusions 343 and 345 may be made of one material while the other part of the upper portion 312 with the retaining grooves 324 and 325 may be made of a different material. In addition, the present embodiment further allows the lateral surface 314 of the modular drain to be replaced by disengaging the interlocking protrusions 343 and 345 from the retaining grooves 324 and 325, respectively to separate the assembled parts from each other. This is a desirable feature in that the lateral surface 314 is exposed to the environment, and thus, prone to wear and damage.

The modular drain of the present invention and the connectors used to provide a drain system may be readily manufactured, for instance, by extrusion, casting, or molding, using any appropriate material. Such manufacturing techniques allow the modular drain of the present invention to be manufactured economically. Further benefits of the modular drain of the present invention is realized in that it is easy to manufacture due to its cross sectional shape which minimizes the number and extent of appendages required to form the liquid stops, if provided, as compared to various conventional modular drain designs.

In this regard, the modular drain of the present invention may be extruded from any of a variety of suitable compositions, preferably plastic or resins, but may also be made of metals, such as aluminum. Suitable resinous compositions include various thermoplastic as well as thermosetting compositions including polyvinyl chloride (hereinafter "PVC"), various polyolefins such as polyethylene or polypropylene, polycarbonates, nylon, polyesters, polymethylmethacrylate, and the like, which are resins known to possess suitable properties for an application of this type.

In the above regard, the modular drain of the present invention may be formed in entirety from PVC. Alternatively, the modular drain may also be co-extruded with the upper portion or the lateral surface being formed from weatherable PVC while the remainder of the modular drain may be formed from extrudable plastic. This allows the portion of the modular drain that is subject to environmental wear and degradation such as the lateral surface to be made of highly durable material while the remaining portion of the modular drain that is may be made of plastic which is less expensive. Such a composite drain may be formed in separate pieces as in the embodiment of FIG. 7, or be formed integrally together as shown in the other embodiments. Thus, in the above described manner, the modular drain in accordance with the present invention may be manufactured in a very economical manner.

In a similar regard, the thicknesses of various portions of the modular drain may be chosen to provide the greatest thickness where strength is needed, such as the lateral surface of the upper portion of the modular drain which must support weight of persons walking on the modular drain. When the modular drain and connectors are made of PVC, conventional bonding compositions such as bonding cement may be applied to the components to be connected, and the components joined and held for the brief period required for the bonding cement to cure and adhere the components together.

As previously noted, the modular drain in accordance with the present invention may be utilized in various applications such as a drain for a lateral surface of a deck, walkway, pool deck, or the like. The modular drain in accordance with the present invention may also be installed with one edge of the lateral surface of the upper portion abutting a wall, curb, foundation, etc. to thereby allow removal of any accumulations of liquid that tend to accumulate at those points, for example, against a building wall. As previously noted, the modular drain also provides an expansion and/or contraction joint when installed.

While various embodiments in accordance with the present invention have been shown and described, it is understood that the invention is not limited thereto. In this regard, it is again noted that the above described dimensions of the modular drain is provided for example purposes only and the dimensions may be modified depending on the specific application of the modular drain and drain system. The present invention may be changed, modified and further applied by those skilled in the art. Therefore, this invention is not limited to the detail shown and described previously, but also includes all such changes and modifications.

We claim:

1. A modular drain for receiving drainage liquid comprising:

a polygonal upper portion having a substantially lateral surface, a first vertical surface and a second vertical surface, said first and second vertical surfaces extending from edges of said substantially lateral surface to define an upper cavity, and said substantially lateral surface having a plurality of openings thereon to allow entry of liquid into said upper cavity; and a lower portion joined to said upper portion, said lower portion including a substantially semi-circular surface sized to receive a tube section of a connector therein, said tube section of said connector having a circular cross-section;

wherein at least one of said first vertical surface and said second vertical surface is provided with a retention mechanism sized and positioned along mid-portion of said at least one of said first vertical surface and said second vertical surface and cantilevered there from to inwardly protrude into said upper cavity to contact and retain said tube section in said lower portion, said retention mechanism being a retention groove that inwardly protrudes into said upper cavity, said retention groove being adapted to receive at least one of concrete and aggregate to support said modular drain along said mid-portion.

2. The modular drain of claim 1, wherein said semi-circular surface has a radius in the range of approximately 0.95 to 0.975 inch, inclusive.

3. The modular drain of claim 2, wherein said tube section has a radius of approximately 0.95 inch.

4. The modular drain of claim 1, wherein said retention mechanism is provided on both said first vertical surface and said second vertical surface.

5. The modular drain of claim 4, wherein said retention mechanism contacts and retains an outer surface of said tube section of said connector at approximately 10 o'clock and 2 o'clock positions.

6. The modular drain of claim 1, wherein said retention groove is substantially semi-circular having a radius of approximately 0.125 inch.

7. The modular drain of claim 6, wherein said retention mechanism is positioned approximately 1.625 inches from a bottom of said semi-circular surface.

8. The modular drain of claim 1, wherein at least one of said first vertical surface and said second vertical surface includes an inwardly protruding ancillary groove adapted to receive at least one of concrete and aggregate therein.

9. The modular drain of claim 1, wherein said substantially lateral surface of said polygonal upper portion includes at least one sloping portion that directs flow toward said plurality of openings.

10. The modular drain of claim 1, wherein said substantially lateral surface of said polygonal upper portion has a thickness greater than at least one of said first vertical surface and said second vertical surface.

11. The modular drain of claim 1, wherein said lower portion includes support feet adapted to resist tipping of said modular drain.

12. The modular drain of claim 1, wherein at least one of said upper portion and said lower portion is made of at least one of a plastic and resin material.

13. The modular drain of claim 12, wherein said at least one of plastic and resin material is selected from a group consisting of polyvinyl chloride, polyethylene, polypropylene, polycarbonate, nylon, polyester, polymethylmethacrylate, and composites thereof.

14. The modular drain of claim 12, wherein at least one of said upper portion and said lower portion is made using an extrusion process.

15. The modular drain of claim 12, wherein said upper portion and said lower portion are made together using a same material.

16. The modular drain of claim 12, wherein said upper portion and said lower portion are made together using differing materials.

17. The modular drain of claim 16, wherein said upper portion and said lower portion are extruded together.

18. The modular drain of claim 1, wherein said modular drain is a single unitary unit with said lower portion being integrally joined to said upper portion.

19. The modular drain of claim 1, wherein said modular drain is an assembled unit, and first and second vertical surfaces of said upper portion are provided with interlocking interfaces.

20. The modular drain of claim 19, wherein said interlocking interfaces include interlocking protrusions.

21. The modular drain of claim 20, wherein said first vertical surface and said second vertical surface are each provided with a retention mechanism.

22. The modular drain of claim 21, wherein said retention mechanisms are retention grooves sized to interlock with said interlocking protrusions.

23. A modular drain for receiving drainage liquid comprising:

a polygonal upper portion having a substantially lateral surface, a first vertical surface and a second vertical surface, said first and second vertical surfaces extending from edges of said substantially lateral surface to define an upper cavity, and said substantially lateral surface having a plurality of openings thereon to allow entry of liquid into said upper cavity; and a lower portion joined to said upper portion, said lower portion including a substantially semi-circular surface joined to said first and second vertical surfaces of said upper portion, said substantially semi-circular surface of said lower portion being sized to receive a tube section of a connector therein, said tube section of said connector having a circular cross-section;

wherein said first vertical surface and said second vertical surface include retention grooves that are cantilevered from mid-portions of said first vertical surface and said second vertical surface to inwardly protrude into said upper cavity, said retention grooves being sized and positioned along said first vertical surface and said second vertical surface to contact and retain an outer surface of said tube section of said connector, and to receive at least one of concrete and aggregate therein to support said modular drain along said mid-portion.

24. The modular drain of claim 23, wherein said semi-circular surface has a radius in the range of approximately 0.95 to 0.975 inch, inclusive.

25. The modular drain of claim 24, wherein said tube section has a radius of approximately 0.95 inch.

26. The modular drain of claim 23, wherein said retention grooves are substantially semi-circular having a radius of approximately 0.125 inch.

27. The modular drain of claim 23, wherein said retention grooves are positioned approximately 1.625 inches from a bottom of said semi-circular surface.

28. The modular drain of claim 23, wherein said retention grooves contact and retain said outer surface of said tube section at approximately 10 o'clock and 2 o'clock positions.

29. The modular drain of claim 23, wherein said substantially lateral surface of said polygonal upper portion includes sloping portions that direct flow toward said plurality of openings.

30. The modular drain of claim 23, wherein said substantially lateral surface of said polygonal upper portion has a thickness greater than at least one of said first vertical surface and said second vertical surface.

31. The modular drain of claim 23, wherein said lower portion includes support feet adapted to resist tipping of said modular drain.

32. The modular drain of claim 23, wherein said modular drain is extruded from material selected from a group consisting of polyvinyl chloride, polyethylene, polypropylene, polycarbonate, nylon, polyester, polymethylmethacrylate, and composites thereof.

33. The modular drain of claim 23, wherein said modular drain is a single unitary unit with said lower portion being integrally joined to said upper portion.

34. The modular drain of claim 23, wherein said modular drain is an assembled unit, and first and second vertical surfaces of said upper portion are provided with interlocking interfaces.

35. The modular drain of claim 23, wherein said interlocking interfaces include interlocking protrusions sized to be received in said retention grooves.

36. A modular drain for receiving drainage liquid comprising:

a polygonal upper portion having a substantially lateral surface, a first vertical surface and a second vertical surface, said first and second vertical surfaces extending from edges of said substantially lateral surface to define an upper cavity, and said substantially lateral surface having a plurality of openings thereon to allow entry of liquid into said upper cavity; and a lower portion joined to said upper portion, said lower portion including a substantially semi-circular surface sized to receive a tube section of a connector therein, said tube section of said connector having a circular cross-section;

wherein said first and second vertical surfaces of said upper portion are provided with interlocking interfaces adapted to allow assembly of said modular drain, and said first vertical surface and said second vertical surface are also provided with at least one groove positioned along mid-portion thereof to retain said tube section in said lower portion, said groove further being adapted to receive at least one of concrete and aggregate therein to support said modular drain along said mid-portion.

37. The modular drain of claim 36, wherein said interlocking interfaces include interlocking protrusions.

38. The modular drain of claim 37, wherein said first vertical surface and said second vertical surface are each provided with a retention mechanism.

39. The modular drain of claim 38, wherein said retention mechanisms are retention grooves sized to interlock with said interlocking protrusions.

* * * * *